US008093476B2

(12) United States Patent
Vochezer

(10) Patent No.: US 8,093,476 B2
(45) Date of Patent: Jan. 10, 2012

(54) CAPO TASTO

(75) Inventor: Georg Vochezer, Argenbuehl-Christazhofen (DE)

(73) Assignee: Wittner GmbH & Co. KG, Isny (DE)

( * ) Notice: Subject to any disclaimer, the term of this patent is extended or adjusted under 35 U.S.C. 154(b) by 0 days.

(21) Appl. No.: 12/857,989

(22) Filed: Aug. 17, 2010

(65) Prior Publication Data

US 2011/0023683 A1 Feb. 3, 2011

Related U.S. Application Data

(63) Continuation of application No. PCT/EP2009/052984, filed on Mar. 13, 2009.

(30) Foreign Application Priority Data

Mar. 19, 2008 (DE) ..... 10 2008 015 583

(51) Int. Cl.
*G10D 3/00* (2006.01)

(52) U.S. Cl. ..... 84/318

(58) Field of Classification Search ..... 84/312 R, 84/317, 318, 315
See application file for complete search history.

(56) References Cited

U.S. PATENT DOCUMENTS

| | | | | |
|---|---|---|---|---|
| 2,604,805 | A | 8/1950 | Haffner | |
| 3,647,930 | A | 3/1972 | Wowries | |
| 3,823,247 | A | 7/1974 | Bauerfeind | |
| 4,793,234 | A | 12/1988 | Geis | |
| 5,492,045 | A | 2/1996 | Roblee | |
| 6,573,440 | B1 | 6/2003 | Rodriguez | |
| 7,390,948 | B2 * | 6/2008 | Walworth | 84/318 |
| 2009/0241752 | A1 | 10/2009 | Vochezer | |

FOREIGN PATENT DOCUMENTS

| | | | |
|---|---|---|---|
| DE | 358 280 | A | 8/1921 |
| DE | 382 448 | C | 2/1923 |
| DE | 32 01 283 | A1 | 7/1983 |
| DE | 42 24 137 | A1 | 1/1993 |
| EP | 1 443 408 | A | 10/2001 |
| GB | 2 141 860 | A | 1/1985 |

* cited by examiner

*Primary Examiner* — Kimberly Lockett
(74) *Attorney, Agent, or Firm* — Womble Carlyle Sandridge & Rice LLP

(57) ABSTRACT

Capo tasto for fixing on a neck of a stringed musical instrument, comprising a first arm on which a string engaging region is arranged, a second arm on which a engaging region for a neck rear side is arranged, a slide bearing for holding the first arm for displacement on the second arm, the slide bearing having a displacement guide which is formed by at least one slot or at least one groove with an opening direction transverse to a displacement direction, at least one first contacting surface which is formed on the first arm, and at least one second contacting surface which is formed on the second arm, a movability apart of the first arm and the second arm, which increases the spacing between the string engaging region and the neck rear side engaging region being lockable by contact of the at least one first contacting surface and the at least one second contacting surface, and the opening direction being oriented at least approximately parallel to the first contacting surface and at least approximately parallel to the second contacting surface.

31 Claims, 6 Drawing Sheets

CAPO TASTO

CROSS-REFERENCE TO RELATED APPLICATION

This application is a continuation of international application number PCT/EP2009/052984, filed on Mar. 13, 2009, which claims priority to German patent application number 10 2008 015 583.7, filed Mar. 19, 2008, which are both incorporated herein by reference in their entirety and for all purposes.

BACKGROUND OF THE INVENTION

The invention relates to a capo tasto for fixing on a neck of a stringed musical instrument, comprising a first arm on which a string engaging region is arranged, and a second arm on which an engaging region for a neck rear side is arranged.

Capo tastos are used to shorten the vibrating length of strings of a stringed musical instrument. A capo tasto is clamped around the neck of the stringed musical instrument between two frets and presses the strings onto the frets. The string length between a bridge of the stringed musical instrument and the fret lying nearest the bridge then remains usable in terms of playing.

From DE 10 2006 059 821 B3 a capo tasto is known, which comprises a string contact device, a tensioning band for fixing the string contact device on the neck, and a fixing device for fixing the tensioning band on the string contact device. There is arranged on the string contact device at least one clip, by means of which the capo tasto can be hooked on the neck of the stringed musical instrument.

From EP 1 143 408 B1 a capo tasto is known, which comprises a string engaging arm, a clamping arm, and a pivotal connection to pivotally interconnect the clamping arm and the string engaging arm at a position along the arms. The pivotal connection includes a releasable locking mechanism to selectively lock the pivotal connection and the relative pivotal movement of the clamping arm and the string engaging arm against movement in an opening direction, whilst at the same time allowing relative pivotal movements in a closing direction.

From U.S. Pat. No. 4,793,234 a capo tasto is known, which comprises a rigid arm adapted to extend transversely across the neck over strings of a stringed musical instrument. A string engaging part is arranged on this arm. A spring-like, C-shaped part is connected to the arm. A clamping force can be applied by means of this part.

From U.S. Pat. No. 2,604,805 a capo tasto is known, which comprises two L-shaped parts which are connected by a bolt with a wing nut screwed thereon.

A capo tasto with a U-shaped frame is known from GB 2 141 860 A.

A further capo tasto is known from U.S. Pat. No. 6,573,440 B1.

From DE 358 280 a capo tasto for lutes and similar musical instruments with a spring for pressing down onto the strings is known. Two semicircular legs with handles are provided, which lie within a spiral spring such that when pressed together they lift the bridge connected to them off the strings. Rolls are provided, which slide on the neck of the instrument.

SUMMARY OF THE INVENTION

In accordance with the present invention, a capo tasto is provided, which is easily fixed to the neck of a stringed musical instrument and has advantageous features.

In accordance with an embodiment of the invention, a slide bearing is provided for holding the first arm for displacement on the second arm, the slide bearing having a displacement guide which is formed by at least one slot or at least one groove with an opening direction transverse to a displacement direction, at least one first contacting surface which is formed on the first arm and at least one second contacting surface which is formed on the second arm are provided, a movability apart of the first arm and the second arm, which increases the spacing between the string engaging region and the neck rear side engaging region being lockable by contact of the at least one first contacting surface and the at least one second contacting surface, and the opening direction being oriented at least approximately parallel to the first contacting surface and at least approximately parallel to the second contacting surface.

The capo tasto in accordance with the invention can be easily manufactured with a minimization of the number of required components.

Single-handed operation of the capo tasto is possible. Fitting and release of the fixing are possible with one hand.

The contacting surfaces are configured so as to only be effective when a pressing force is exerted on the arms by the neck, i.e., when a fixing or prefixing has taken place on the neck of the stringed musical instrument. A proportioning of the clamping pressure is thereby made possible. Too great a clamping pressure on a string may cause the string to be put out of tune. Too low a clamping pressure may cause a whirring of the string. An optimized setting is possible with the solution in accordance with the invention.

The slide bearing has a displacement guide which is arranged on the second arm. Such a displacement guide can be constructed in a simple way. The displacement guide is formed by at least one slot or at least one groove on an arm (such as, for example, the second arm). The other arm (for example, the first arm) or an element fixed on the other arm can be guided in the at least one slot or in the at least one groove.

If the opening direction of the at least one slot or the at least one groove is parallel to the first contacting surface and the second contacting surface, then with a simple constructional design, the movability apart can be locked in a simple way when the capo tasto is clamped on the neck, without any other aids being required for the fixing (such as screws or the like). This makes single-handed operability possible in a simple way. The number of components required is thereby minimized. Also, a setting of the pressing force is possible in a simple way as a movability towards each other is made possible.

The opening direction is a direction transverse to the displacement direction. It faces the exterior space and is an insertion direction via which (at least) one pin element of the other arm is inserted into the at least one slot or groove. The opening direction lies at least approximately parallel to the strings. Furthermore, it is oriented transversely to a side face of the corresponding arm.

The opening direction is that direction in which the at least one slot or the at least one groove is not bounded, at least at one side, by material of that arm on which the at least one slot or the at least one groove is formed.

The at least approximate parallelism of the opening direction to the first contacting surface and the second contacting surface exists in each contacting position of the first contacting surface and the second contacting surface and, in particular, in each position of the first arm in relation to the second arm.

In capo tastos known from the prior art, in which a first arm and a second arm are purely pivotally movable relative to each other, the fundamental problem occurs that once the fixing starts, a string engaging region is no longer optimally alignable. Up until a final clamping position is reached, an arm executes a circular movement owing to the pivot bearing. With the solution in accordance with the invention, the slide bearing makes a linear movement of the first arm possible, which is aligned transversely and, in particular, at least approximately perpendicularly to the strings of the musical instrument. A uniform distribution of pressure on all the strings can thereby be achieved and any errors owing to an imprecise fitting of the capo tasto can be easily corrected.

With the solution in accordance with the invention, the first arm or the second arm may, in each case, be of one-part or multipart construction.

It is expedient for the at least one first contacting surface and the at least one second contacting surface to be so constructed that upon contact the movability apart is locked when the capo tasto is clamped on the neck. A pressing force then acts, which locks the movability apart of the first arm and the second arm. A user can, however, still move the first arm towards the second arm if the clamping force is to be increased.

It is then expedient for the at least one first contacting surface and the at least one second contacting surface to be so constructed that a movability towards each other of the first arm and the second arm in a direction opposite to a direction of movability apart of the first arm and the second arm is enabled. The clamping force can thereby be set.

In particular, the displacement guide is a linear guide. It is sufficient for the first arm to be linearly displaceable on the second arm.

It has proven expedient for the at least one second contacting surface to lie at least approximately parallel to the displacement guide. A fixing position can thereby be secured in a simple way.

In a constructionally simple embodiment, the first arm is held by means of at least one pin element on the displacement guide. By means of the at least one pin element, which is inserted in the displacement guide, a displaceability of the first arm on the second arm can be implemented in a simple way. The at least one pin element may be an element which is separate from the first arm and fixed thereon. It may also be integrally formed on the arm. It may, for example, also be constructed as a peg.

A direction of longitudinal extent of the at least one pin element is parallel to the opening direction of the at least one slot or the at least one groove. This direction of longitudinal extent is then parallel to the first contacting surface and the second contacting surface.

In an advantageous embodiment, the slide bearing is constructed as a pivot-slide bearing, with the first arm being pivotable relative to the second arm. The fitting of the capo tasto on and the release of the capo tasto from the neck of the stringed musical instrument are thereby facilitated. The fitting on the neck is facilitated by a pivoting-apart of the first arm and the second arm, and, in particular, a single-handed fitting is facilitated. The release is also facilitated.

In particular, a pivot axis of the pivot-slide bearing lies perpendicular to the displacement direction. The pivot-slide bearing can therefore be constructed in a simple way. A pin element serving as displacement guide for the first arm on the second arm may also serve as shaft for the pivot bearing. The pivot axis is preferably parallel to the opening direction and, consequently, also parallel to the first contacting surface and the second contacting surface.

Expediently, the pivot-slide bearing has a shaft which is guided for displacement in a displacement guide and is rotatable in the displacement guide. The corresponding capo tasto can therefore be manufactured with minimized expenditure.

It is quite particularly advantageous for the displacement guide to be oriented at least approximately perpendicularly to the strings when the capo tasto is fitted on the neck. A uniform distribution of pressure on the strings can thereby be achieved. As a result of a linear and at least approximately perpendicular movability of the first arm with the string engaging region onto the string during the clamping, all of the strings are at least approximately uniformly subjected to pressure.

It is quite particularly advantageous for a pivotable rocker with the string engaging region seated thereon to be arranged on the first arm. In this case, the pivot bearing is, in particular, arranged at the center of the rocker. The clamping pressure of the string engaging region on the strings is uniformly distributed by the pivotable rocker. The pressure distribution on the strings is thereby prevented from varying, which may result in some strings being put out of tune and other strings whirring as a result of too low a pressure. Consequently, a larger pressure range or clamping range is also available to the user before strings are audibly out of tune. Furthermore, owing to the provision of a pivotable rocker, a capo tasto in accordance with the invention is universally usable. There is no longer any necessity for individual adaptation of the clamping width to individual instruments. The uniform distribution of clamping pressure enables use with different fret lengths.

In capo tastos known from the prior art, the fundamental problem occurs that immediately upon contact, a fixing occurs, and, as a result, an optimum alignment of a string engaging region is no longer possible. With the solution in accordance with the invention, owing to the displaceability of the first arm on the second arm, a linear movement, oriented transversely and, in particular, at least approximately perpendicularly to the strings, of the first arm can be performed. If the capo tasto in accordance with the invention is not fitted quite precisely by a user, then this error can be compensated by the pivotable rocker.

In particular, a pivot axis of the rocker is parallel to a pivot axis of a pivot-slide bearing by means of which the first arm is held on the second arm. An optimized distribution of forces is thereby achieved in a simple way.

In an embodiment, the string engaging region is formed by an elastic material. A uniform distribution of forces is thereby achieved in a simple way.

It is quite particularly advantageous for the string engaging region to be formed by an elastic pad. This is, for example, made of one piece. A uniform distribution of pressure on the strings is thereby also achieved if a stringed musical instrument has a curved neck.

It is quite particularly advantageous for the elastic pad to have an engaging surface for strings which varies transversely to a direction of extent of the strings, with the effective engaging surface being smaller for strings of larger diameter than for strings of smaller diameter. The effective engaging surface with which a string engages the elastic pad results from the diameter of the string times the length of contact of the string with the elastic pad. With the same length of contact on the elastic pad, a larger effective engaging surface would result for strings of larger diameter. The string might therefore penetrate the pad to a lesser depth. Owing to the corresponding different formation of the engaging surface for the strings, which ensures that the length of contact of strings of different diameter is different for the engagement at the engaging surface, it is ensured that the effective engaging surface of different strings is at least approximately identical. For example, thicker strings (low pitch strings) are thereby prevented from being able to penetrate the elastic pad to a lesser depth than thinner strings. This, in turn, reduces the risk of thicker strings being able to deviate during the playing of the stringed musical instrument.

In an embodiment which is expedient in terms of manufacturing technology, the elastic pad has a triangular free space. This triangular free space provides a varying string engaging surface which increases in size in one direction. This direction lies transverse to the directions of extent of the strings. Effective string engaging surfaces which are at least approximately identical can thereby be provided for thicker strings and for thinner strings.

It is quite particularly advantageous for the engaging region for the neck rear side to be formed by an elastic pad. Damage caused by placing the second arm on the rear side of the neck is thereby avoided. Furthermore, a fixing of the capo tasto on the neck in a simple way is therefore possible. By exerting pressure on the elastic pad, it is compressed, and, in this way, if the first arm is in a corresponding displacement position in relation to the second arm, a locking position can be achieved by contact of the at least one first contacting surface and the at least one second contacting surface. The locking position can, in turn, be released in a simple way by a further force being exerted on the elastic pad so as to enable a relative pivotability between the first arm and the second arm.

In a constructionally expedient embodiment, the first arm has a channel-shaped region with upwardly extending side rims at which the string engaging region is arranged. The string engaging region can therefore be fixed in a simple way on the first arm and, in particular, pivotally fixed.

In particular, a rocker is pivotally fixed on the upwardly extending side rims. At the side rims, a pin element can be fixed, which, for example, forms an outer shaft for the rocker.

It has proven expedient for the string engaging region to extend beyond a front end of the first arm, i.e., in relation to an end of the string engaging region lying closest to the second arm, the string engaging region has a greater length than the first arm. It has been found that a more uniform clamping pressure is thereby exertable on the strings.

It is expedient for a spring mechanism to be arranged between the first arm and the second arm to exert a force for pushing and/or pivoting the first arm away from the second arm. A capo tasto in accordance with the invention can thereby be fixed in a simple way on the neck, and the fixing can be released in a simple way. During the fixing, the first arm and the second arm then have a maximum opening width relative to each other, so that an easy fitting is possible. For the release, a pushing-apart can be effected by corresponding application of force.

In particular, the spring mechanism is supported on the first arm and the second arm in order to bring about a corresponding application of force.

It is quite particularly advantageous for the spring mechanism to have a spring region and, in particular, a free end, which is displaceable relative to the second arm and is supported thereon. The spring action is therefore not influenced by the displaceability of the second arm on the first arm. On the other hand, the displaceability of the first arm on the second arm is ensured.

In a compact design, one or more windings of the spring mechanism is or are arranged around a shaft of a pivot-slide bearing.

It is expedient for the at least one contacting surface to be formed by an outer contour region of the first arm, which faces the second arm. This results in a compact construction. The contacting surfaces are then produced by corresponding formation of the outer contours.

For the same reason, it is expedient for the at least one second contacting surface to be formed by an outer contour region of the second arm, which faces the first arm.

In terms of manufacturing technology, it is, furthermore, advantageous for the at least one first contacting surface to be integrally formed on the first arm. For the same reason, it is expedient for the at least one second contacting surface to be integrally formed on the second arm. Therefore, no further components need be fixed for formation of a contacting surface on the respective arm.

Expediently, the one arm is constructed at a coupling region with the other arm in the shape of a fork, with opposed fork elements engaging over the other arm. The other arm can thereby be inserted in an intermediate region between fork elements. The two arms can thereby be held in a simple way on each other, and contacting surfaces for locking a fixing position can also be implemented in a simple way.

In particular, at least one contacting surface for the other arm is formed at an intermediate region between the fork elements. A capo tasto in accordance with the invention can therefore be constructed in a compact manner and also easily operated, and, in particular, operated with one hand.

It is expedient for the at least one spring mechanism to be so arranged and constructed that a fixing position on the neck is releasable by exerting pressure on the first arm in the direction of the neck rear side engaging region. In particular, this releasability is possible by exerting pressure in the proximity of a front end of the first arm. A capo tasto can therefore be released in a simple way with single-handed operation.

The following description of preferred embodiments serves in conjunction with the drawings to give a detailed explanation of the invention.

DETAILED DESCRIPTION OF THE INVENTION

Figure 1:
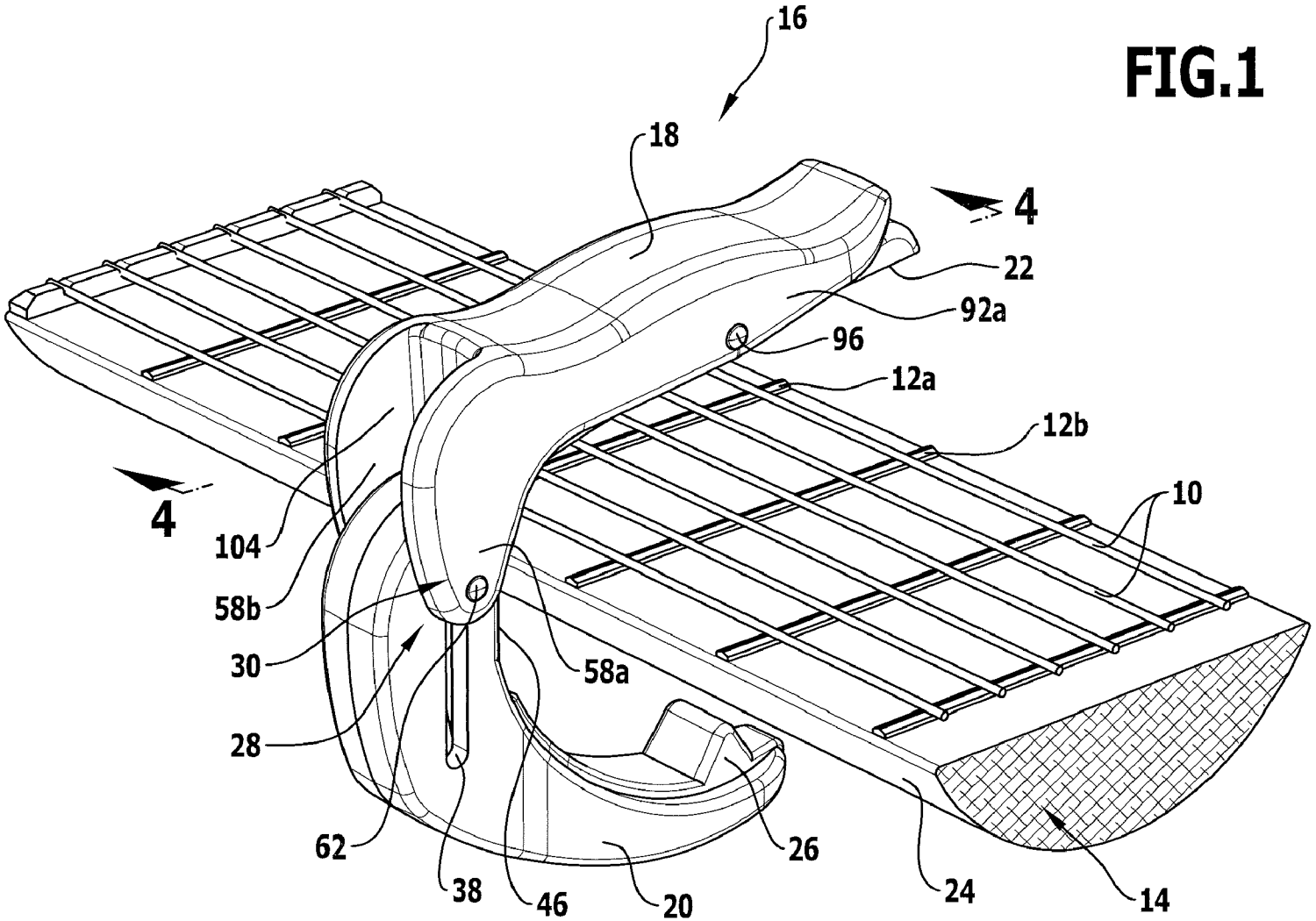
FIG. 1 shows a perspective representation of an embodiment of a capo tasto in accordance with the invention with a section of a neck of a stringed instrument.

A capo tasto is a device that is used to shorten the vibrating length of strings 10 of a stringed musical instrument such as a guitar, a mandolin or a banjo. A capo tasto is placed on a neck 14 of the stringed musical instrument between two frets 12*a*, 12*b* (FIGS. 1, 2) and clamped around the neck 14. The strings 10 are thereby pressed onto the frets 12*a*, 12*b*. The string length that is usable in terms of play is then the length between a bridge of the stringed musical instrument and the one of the two frets that lies nearest the bridge. In the embodiment in accordance with FIG. 2, this is fret 12*b*.

Capo tastos are used, for example, to adapt the corresponding stringed musical instrument to a singing voice. Shortening the strings by means of a capo tasto raises the pitch of the stringed musical instrument; a piece of music therefore no longer has to be transposed into a suitable target key. Capo tastos are also used to convert a piece of music into a form that is technically easy to play without having to change the key in which it sounds.

An embodiment of a capo tasto in accordance with the invention which is shown in FIGS. 1 to 5 and denoted there by 16 comprises a first arm 18 (string contacting arm) and a second arm 20 (neck rear side contacting arm). The first arm 18 serves for placement on the strings 10 and comprises or holds a string engaging region 22. The second arm 20 serves for placement on a rear side 24 of the neck 14 and comprises or holds a neck rear side engaging region 26.

The first arm 18 is held for displacement on the second arm 20 by means of a slide bearing 28. In the embodiment shown and described, the slide bearing is constructed as a pivot-slide bearing 30, by means of which the first arm 18 is also pivotable relative to the second arm 20.

The arm 20 is of C-shaped configuration with a first region 32 on which the pivot-slide bearing 30 is arranged, and a second region 34 on which the neck rear side engaging region 26 is arranged.

A displacement guide 38 extending in a linear direction 36 is arranged on the first region 32. When the capo tasto is fitted, the displacement guide 38 is oriented transversely and, in particular, at least approximately perpendicularly to the strings 10 (see FIG. 3).

Figure 4:
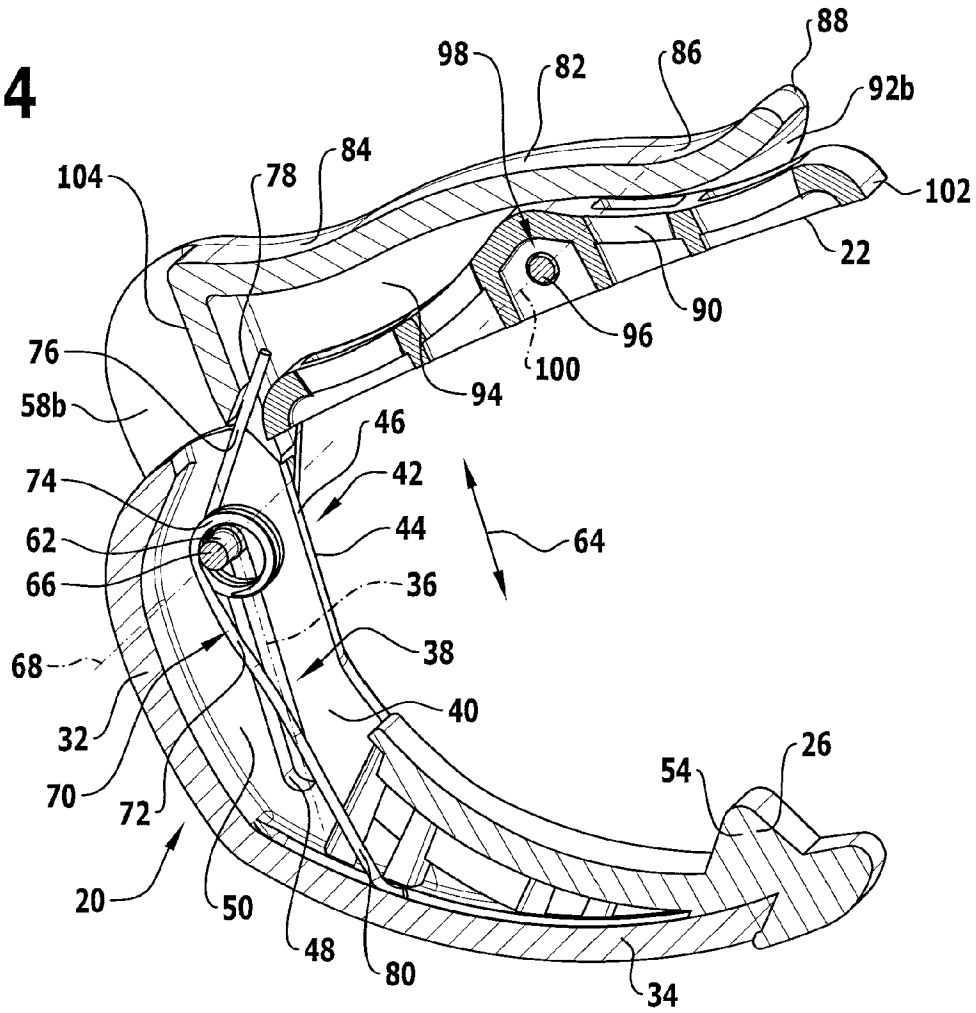
FIG. 4 shows a sectional view taken along line 4-4 in accordance with FIG. 1 (opened capo tasto)

At least in the area of the displacement guide 38, the second arm 20 has an interior space 40 which is covered outwards at one side (FIG. 4). This interior space is open towards another side 42. At the side 42, the second arm 20 has an outer contour 44 which is at least approximately parallel to the linear direction 36. As will be explained in greater detail below, a second contacting surface 46 for the first arm 18 is formed by way of this outer contour 44.

Figure 5:
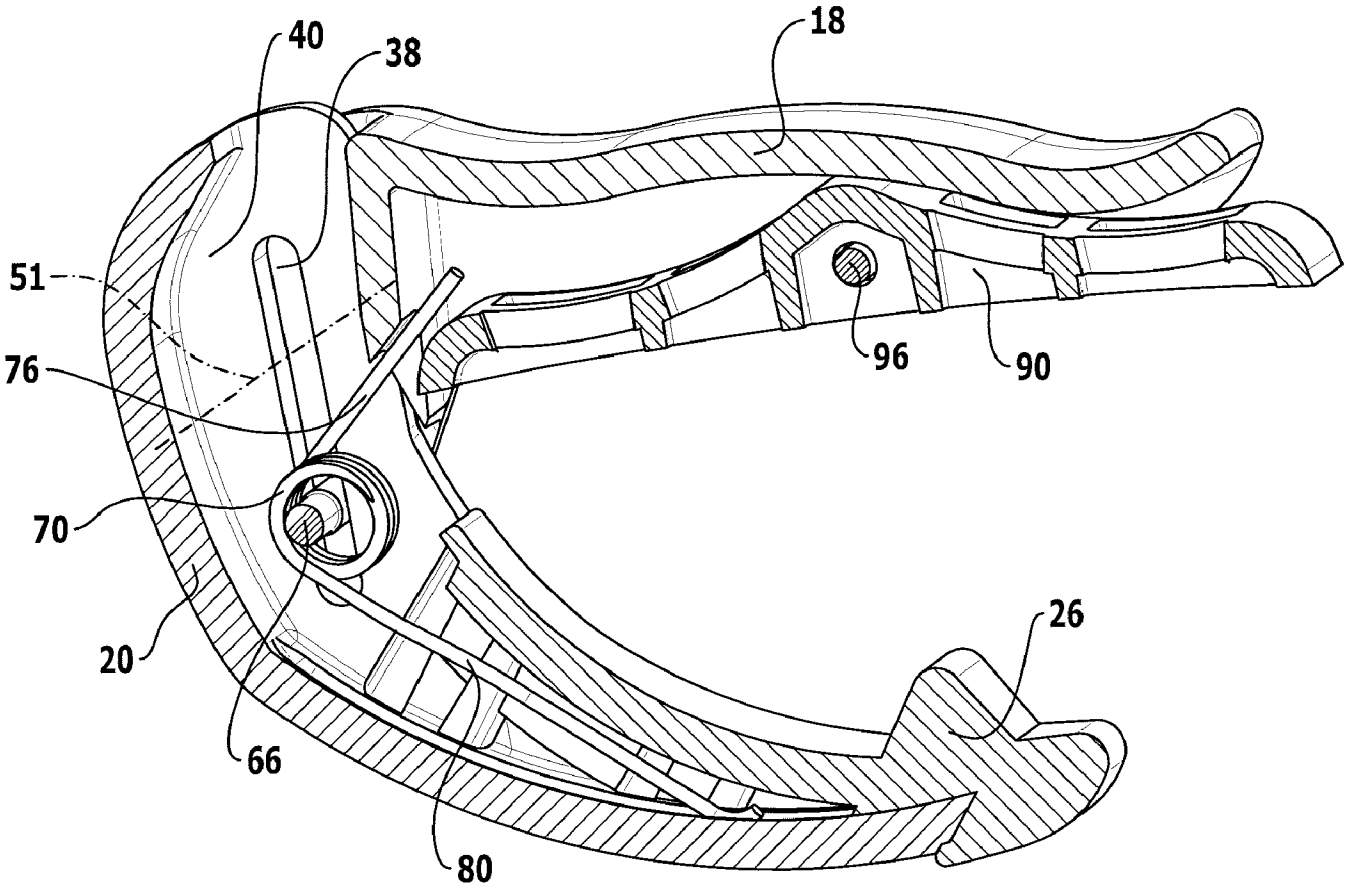
FIG. 5 shows a sectional view taken along line 5-5 in accordance with FIG. 2 (fixed capo tasto)
Figure 7:
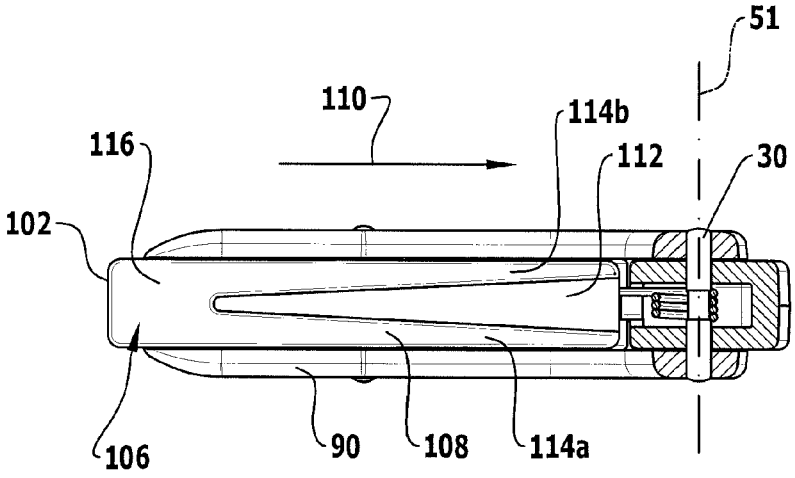
FIG. 7 shows a sectional representation of the capo tasto in accordance with FIG. 6 taken along line 7-7.

The displacement guide 38 is formed by continuous slots 48 formed in alignment with one another in walls 50 which bound the interior space 40 at the sides. The slots 48 have an opening direction 51 (FIGS. 5 and 7). The slot 48 is not bounded by material in the opening direction. The opening direction 51 faces the exterior space.

The second region 34 is arranged at an angle to the first region 32. The second arm 20 has a curved outer contour at the transition from the first region 32 to the second region 34. Opposed side faces 52*a*, 52*b* of the second arm 20 are of substantially flat configuration and parallel to each other. The neck rear side engaging region 26 is formed by an elastic structure such as, for example, an elastic pad 54, which is fixed to or in the proximity of a front end of a second region 34 of the second arm 20.

In the embodiment shown, the elastic pad 54 has, when no pressing forces are being exerted thereon, a triangular cross-sectional shape with a rounded-off tip in the direction of the string engaging region 22.

The first arm 18 has approximately the shape of a large L. It is connected to the second arm 20 by a coupling region 56. The coupling region 56 is of fork-shaped construction with a first fork element 58*a* and a second fork element 58*b* (FIG. 4). The first fork element 58*a* and the second fork element 58*b* are spaced apart with an intermediate space 60 between them. The second arm 20 extends into the intermediate space 60, and the first fork element 58*a* and the second fork element 58*b* embrace the second arm 20 at the side faces 52*a* and 52*b*.

A pin element 62 is fixed to the first fork element 58*a* and to the second fork element 58*b*. It passes through the slots 48 in the second arm 20. A direction of passage is parallel to the opening direction 51. The pin element 62 is displaceable in the displacement guide 38 in a direction/opposite direction 64. In this way, the first arm 18 is also displaceable relative to the second arm 20. The displacement direction 64 lies transverse and, for example, perpendicular to the opening direction 51. A direction of longitudinal extent of the pin element 62 lies at least approximately parallel to the opening direction 51.

The pin element 62 is fixed in a rotationally fixed or rotational manner at the coupling region 56 of the first arm 18. It is guided with such play in the displacement guide 38 that it is rotatable therein. The pin element 62 thereby forms a shaft 66 of the pivot-slide bearing 30, by means of which the first arm 18 is pivotable relative to the second arm 20 about a pivot axis 68. The pivot axis 68 lies perpendicular to the direction/opposite direction 64 (i.e., also perpendicular to the linear direction 36). The pivot axis 68 preferably lies parallel to the opening direction 51.

A spring mechanism 70 is arranged on the first arm 18 and the second arm 20. It comprises a spiral spring 72 which is supported on the first arm 18 and the second arm 20. The spiral spring 72 comprises spring windings 74 which are arranged around the pin element 62 on the second arm 20. The internal diameter of the spring windings 74 is greater than the external diameter of the pin element 62. The spiral spring 72 is thereby held loosely on the pin element 62.

A spring region 76 extends from an associated last winding into a fixing region 78 of the first arm 18. This spring region 76 is securely fixed to the fixing region 78.

A spring arm 80 is led from the first winding to the second arm 20 and is "loosely" supported in the interior space 40. The support is such that the displaceability of the first arm 18 is not impeded by the spring mechanism 70, i.e., the spring arm 80 is displaceable in the interior space 40. The spring arm 80 is, however, permanently supported on the second arm 20 so as to be able to exert a spring force on the first arm 18.

The spring force of the spring mechanism 70 acts in such a way that it attempts to move the first arm 18 away from the second arm 20, i.e., to enlarge the spacing between the string engaging region 22 and the neck rear side engaging region 26.

The first arm 18 has an upper side 82, which comprises a first hollow region 84 at or in the proximity of the coupling region 56, and a second hollow region 86 at or in the proximity of a front end 88. The first hollow region 84 serves as engagement surface for the finger of a user when the capo tasto 16 is to be fixed on the neck 14. The second hollow region 86 serves as engagement surface for the finger of a user when the capo tasto 16 is to be released from a fixing position.

The upper side 82 of the first arm 18 is of smooth configuration. In the direction towards the neck rear side engaging region 26, the first arm 18 is of channel-shaped configuration with upwardly extending side rims 92*a*, 92*b*, between which an intermediate space 94 lies, which is open towards the neck rear side engaging region 26.

A rocker 90 is pivotally arranged on the first arm 18. For this purpose, a pin element 96 which extends through the intermediate space 94 is fixed at the side rims 92*a*, 92*b*. The rocker 90 is seated on this pin element 96.

The pin element 96 forms an (outer) shaft of a pivot bearing 98. A pivot axis 100 of this pivot bearing 98 is parallel to the pivot axis 68 of the pivot-slide bearing 30.

The string engaging region 22 is, in turn, arranged on the rocker 90. It is of such width that it can extend over all the strings of a fingerboard of the corresponding stringed musical instrument.

Facing an inner side of the first arm 18, the rocker 90 is of such configuration that a pivotal movement is possible within a certain angular range of, for example, between −5° and +5°.

The rocker 90 extends with a front end 102 beyond the front end 88 of the first arm 18.

A first contacting surface 104 which in cooperation with the second contacting surface 46 locks a fixing position of the capo tasto 16 on the neck 14 is arranged on the first arm 18. (It is also possible for several first contacting surfaces 104 and second contacting surfaces 46 to be provided; for example, such a plurality of contacting surfaces is created by providing partial areas. For the sake of simplicity, one contacting surface will always be referred to below; in principle, this may also be of multipart configuration.)

The opening direction 51 is oriented parallel to the first contacting surface 104 and the second contacting surface 46.

The first contacting surface 104 is formed on the coupling region 56 between the first fork element 58*a* and the second fork element 58*b*. The second arm 20 with its second contacting surface 46 extends, depending on the displacement position of the first arm 18, into the intermediate space 60, and the first contacting surface 104 can abut against the second contacting surface 46.

The first contacting surface 104 and the second contacting surface 46 are each formed integrally on the associated arm 18 and 20, respectively. They are formed on an outer contour facing the other arm. The outer contour 44 of the second arm 20, on which the second contacting surface 46 is formed, then faces a boundary surface of the intermediate space 60, on which the first contacting surface 104 is formed. In a corresponding manner, an outer contour of the first arm 18 faces the coupling region 56 of the outer contour 44 of the second arm 20.

The first arm 18 and the second arm 20 are made of, for example, a plastic material. The rocker 90 is also made of a plastic material.

Figure 6:
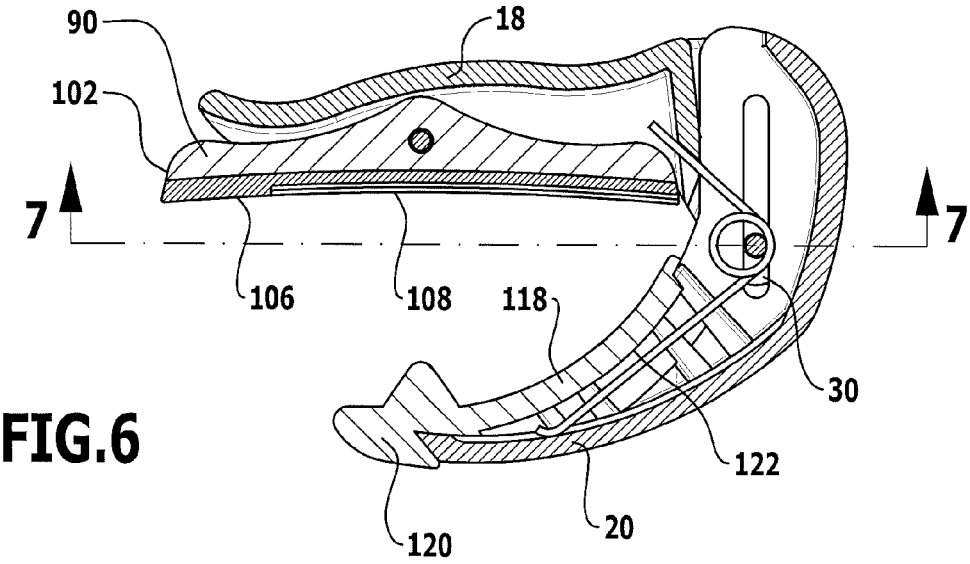
FIG. 6 shows a further embodiment of a capo tasto in accordance with the invention in a sectional view.

In an embodiment shown in FIGS. 6 and 7, the string engaging region 22 is configured as an elastic pad 106. In particular, it is made in one piece. This elastic pad 106 is arranged on the rocker 90. The elastic pad 106 has an engaging surface 108 for strings 10, with which it acts on the strings 10. The engaging surface 108 varies in its configuration in a direction 110 which lies transverse to the strings 10: The engaging surface 108 increases in size away from the pivot-slide bearing 30. For example, the elastic pad 106 has, for this purpose, a free space 112 which is of triangular configuration. The elastic pad 106 therefore has a first flank 114*a* and a second flank 114*b*, between which the free space 112 lies. The free space 112 does not have any engaging region for the strings 10. The first flank 114*a* and the second flank 114*b* are connected by a bridge element 116 in the area of the front end 102 of the rocker 90.

The elastic pad 106 has a wedge-shaped recess over the free space 112. This shortens the area of contact of a string 10 on the string engaging region 22.

The neck 14 of a stringed musical instrument is often curved. Such a curve can be compensated transversely to the strings 10 by the elastic pad 106.

Musical instruments are stringed with strings of various thicknesses. Thicker strings produce lower notes and thinner strings produce higher notes. These differences, which give rise to different effective engaging surfaces, can be compensated on the capo tasto 16 by the formation of the engaging surface 108 with a varying configuration. The effective engaging surface of a string on the elastic pad 106 results from the product of the diameter of the corresponding string 10 and the length of contact of the corresponding string 10 on the pad 106. The length of contact on the pad can be shortened by the free space 112 as the engaging surface decreases in size in direction 110. The effective engaging surfaces of all strings can thereby be made to match one another at least approximately. For thinner strings that are further away from the pivot-slide bearing 30, the diameter is indeed smaller, but the length of contact on the elastic pad 106 is greater. For strings that are closer to the pivot-slide bearing 30 (low pitch strings) the diameter is greater and owing to the free space 112 the length of contact is smaller.

A uniform depth of penetration of all strings 10 into the elastic pad 106 is thereby achieved. In particular, thinner strings are thereby prevented from penetrating deeper into the elastic pad 106 than thicker strings, which might cause the thicker strings to deviate sideways during play.

The neck rear side engaging region 26 is formed, for example, by an elastic pad 118 which is pushed onto the second arm 20 and, for example, in a region 120 (FIG. 6) hooked thereto. The elastic pad 118 is, for example, additionally adhesively connected to the second arm 20. It preferably extends over a total region 122 of the second arm 20, which may come into contact with the neck 14 of the stringed musical instrument.

In other respects, the first arm 18 and the second arm 20 are constructed in the same way as described above.

Figure 2:
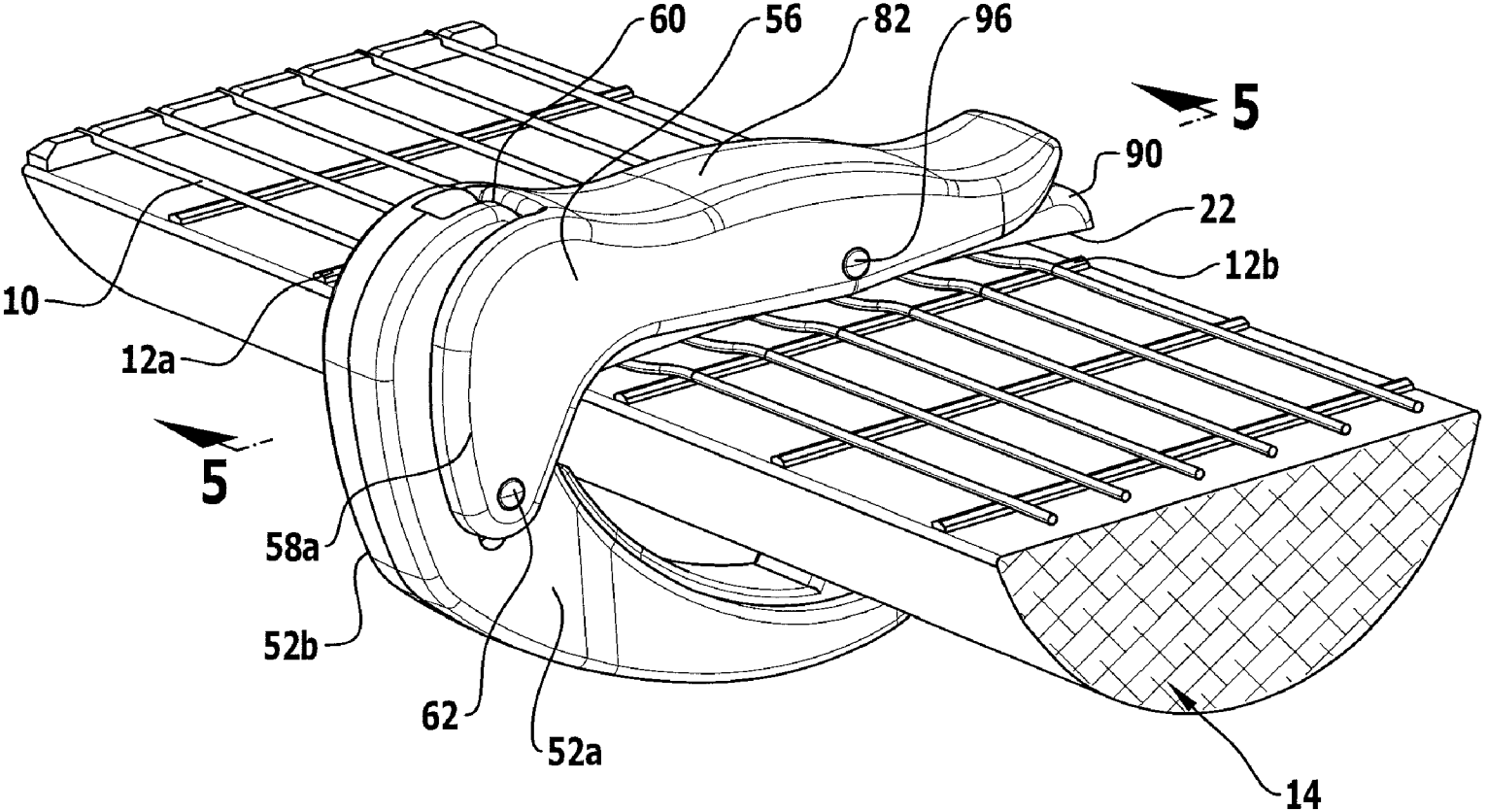
FIG. 2 shows the same view as in FIG. 1, with the capo tasto fixed on the neck.
Figure 3:
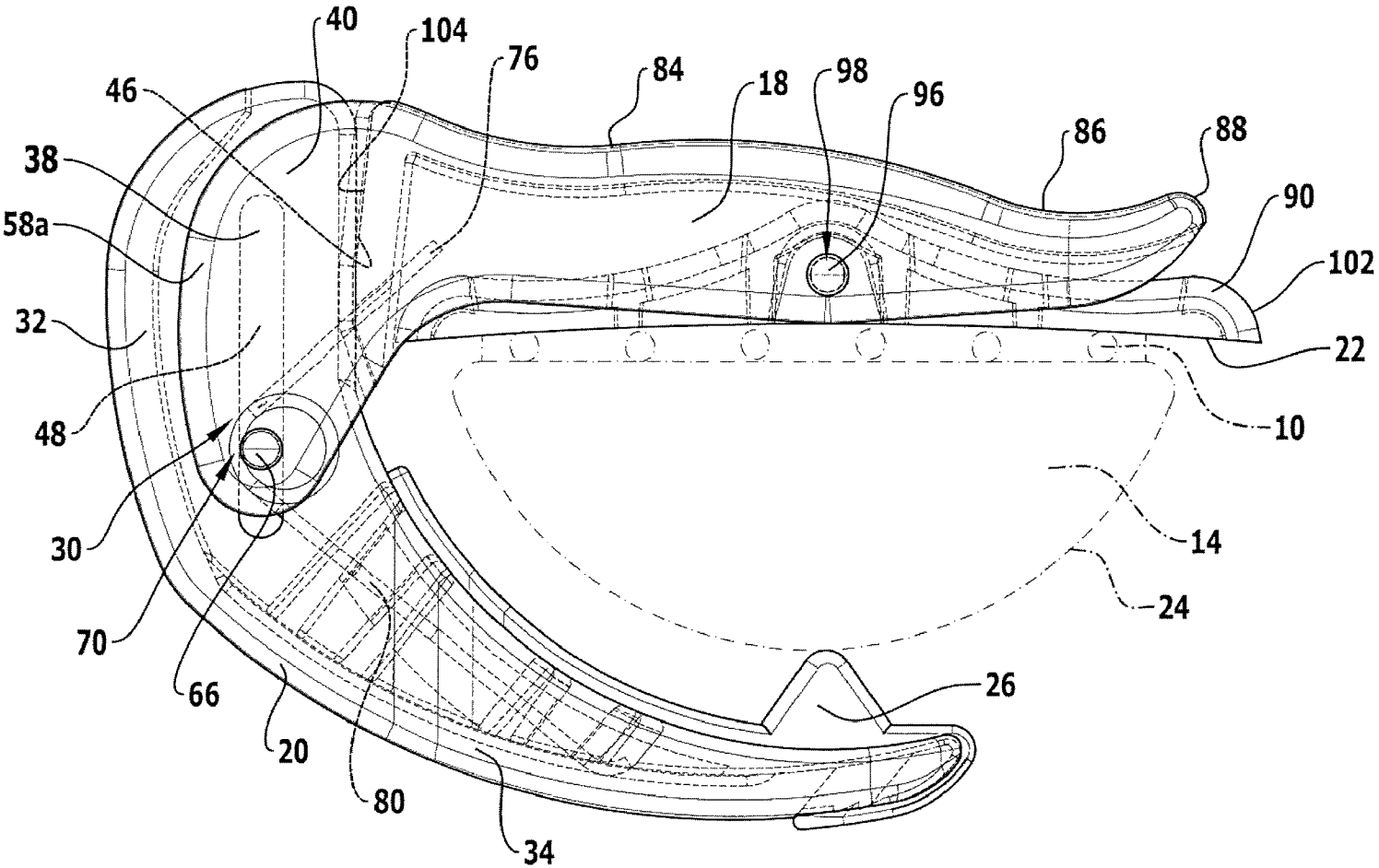
FIG. 3 shows a side view of the capo tasto in accordance with FIG. 1, with concealed elements drawn in broken lines.

The capo tasto in accordance with invention operates as follows:

When the pin element 62, as shown in FIG. 1, is pushed upwards, then the string engaging region 22 is spaced farthest from the neck rear side engaging region 26. The spring force of the spring mechanism 70 also presses the first arm 18 in a pivoting direction about the pivot axis 68 away from the second arm 20 until a surface which bounds the intermediate space 60 abuts against an upper region of the outer contour 44. The capo tasto 16 then has a maximum opening width, and it can be easily fitted on the neck 14 of a stringed musical instrument.

In this case, single-handed operation is possible.

The capo tasto 16 is fitted on the stringed musical instrument such that thicker strings (low pitch strings) lie closer to the pivot-slide bearing 30 and thinner strings (high pitch strings) are further away. It is thereby ensured that the length of contact of the corresponding strings on the elastic pad 106 will behave at least approximately reciprocally to the diameter of the corresponding string 10.

A user then pushes down the arm 18 at the displacement guide 38 in the direction/opposite direction 64, and the string engaging region 22 is thereby displaced towards the neck rear side engaging region 26.

The easiest way to do this is for the second arm 20 to be held at its underside with one or more fingers and for the user to act with his thumb in the first hollow region 84 on the first arm 18 in order to displace it.

In doing so, the user exerts pressure on the first arm 18. A pushing onto the strings 10 and a tightening are thereby effected. No further pivotal movement takes place.

The at least approximately perpendicular orientation of the displacement guide 38 to the strings 10 enables a uniform application of pressure to all strings 10. Since no pivotal movement occurs, which, in principle, results in different strings being subjected to pressure of different strength, a uniform pressing of the strings on the frets 12*a*, 12*b* is achieved for all strings 10.

The fixing is released by a user pressing, for example, with his thumb on the second hollow region 86. He simultaneously applies tension from below to the second arm 20. Owing to the elastic construction of the neck rear side engaging region 26, the fixing can be released, and the arm 18 is pushed upwards on the second arm 20 in the displacement guide 38 by the spring force of the spring mechanism 70.

As mentioned above, the fixing and the locking are possible with one hand.

If too high a clamping pressure was selected or the position of a fixed capo tasto 16 has to be changed, it is possible to bring about the release without changing the hand grip. The thumb then only has to be shifted from the first hollow region 84 to the second hollow region 86.

The spring mechanism 70 and the pivotable bearing of the first arm 18 on the second arm 20 serve for simple fitting/releasing of the capo tasto 16 on the neck 14. The provision of an "only"-slide bearing and the provision of a first contacting surface 104 and a second contacting surface 46 suffice for fixed holding of the capo tasto 16 on the neck 14.

When the capo tasto 16 is held under pressure on the neck 14, then the first contacting surface 104 presses against the second contacting surface 46 and a locking position is fixed. There is no need for any other aids such as screws or the like for fixing this locking position. The fixing of the locking position results from the parallel orientation of the opening direction 51 to the first contacting surface 104 and the second contacting surface 46. If a greater clamping force (tightening force on the strings 10) is to be applied, then the first arm 18 can be displaced further in the displacement guide 38. A proportioning of the tightening force is therefore possible. The movement apart of the first arm 18 and the second arm 20 is locked by the first contacting surface 104 and the second contacting surface 46 in one direction only, which increases the spacing between the string engaging region 22 and the neck rear side engaging region 46. In the direction opposite thereto, a further movability (by the application of force) is possible to increase the tightening force.

The clamping pressure can be distributed uniformly onto the strings 10 by the rocker 90 on which the string engaging region 22 is arranged. In particular, for this purpose, the pin element 96, which forms a shaft for the rocker 90, is arranged at the center of the rocker 90, so as to enable uniform distribution of the clamping pressure.

Consequently, with the solution in accordance with the invention it is no longer absolutely necessary for the capo tasto 16 to be placed exactly on the strings 10. (In capo tastos known from the prior art an exact fitting on the strings is absolutely necessary, otherwise the distribution of pressure on the strings will vary greatly. A widely varying distribution of pressure may result in some of the strings being out of tune owing to too high a pressure, while the pressure on other strings is too low, which may cause a corresponding string to whirr.)

With the solution in accordance with the invention, a larger pressure range is also available to a user before strings 10 are audibly out of tune.

In principle, it is the case that different stringed musical instruments have different fret lengths. Since a uniform application of pressure on the strings 10 is achievable with the solution in accordance with the invention, there is no necessity for the clamping width to be adapted to the respective fret length. This means that the capo tasto 16 is universally usable.

The clamping pressure with which the string engaging region 22 acts on the strings 10 may be individually set by a user.

That which is claimed:

1. Capo tasto for fixing on a neck of a stringed musical instrument, comprising:

a first arm on which a string engaging region is arranged;

a second arm on which an engaging region for a neck rear side is arranged;

a slide bearing for holding the first arm for displacement on the second arm, the slide bearing having a displacement guide which is formed by at least one slot or at least one groove with an opening direction transverse to a displacement direction;

at least one first contacting surface which is formed on the first arm; and at least one second contacting surface which is formed on the second arm;

wherein a movability apart of the first arm and the second arm, which increases the spacing between the string engaging region and the neck rear side engaging region, is lockable by contact of the at least one first contacting surface and the at least one second contacting surface; and wherein the opening direction is oriented at least approximately parallel to the first contacting surface and at least approximately parallel to the second contacting surface.

2. Capo tasto in accordance with claim 1, wherein the at least one first contacting surface and the at least one second contacting surface are so constructed that upon contact the movability apart is locked when the capo tasto is clamped on the neck.

3. Capo tasto in accordance with claim 1, wherein the at least one first contacting surface and the at least one second contacting surface are so constructed that a movability towards each other in a direction opposite to a movability apart of the first arm and the second arm is enabled.

4. Capo tasto in accordance with claim 1, wherein the displacement guide is a linear guide.

5. Capo tasto in accordance with claim 1, wherein the at least one second contacting surface is at least approximately parallel to the displacement guide.

6. Capo tasto in accordance with claim 1, wherein the first arm is guided by means of at least one pin element on the displacement guide.

7. Capo tasto in accordance with claim 1, wherein the slide bearing is constructed as a pivot-slide bearing, with the first arm being pivotable relative to the second arm.

8. Capo tasto in accordance with claim 7, wherein a pivot axis is oriented perpendicularly to the displacement direction.

9. Capo tasto in accordance with claim 7, wherein the pivot-slide bearing has a shaft which is guided for displacement in a displacement guide and is rotatable in the displacement guide.

10. Capo tasto in accordance with claim 1, wherein the displacement guide is oriented at least approximately perpendicularly to the strings when the capo tasto is fitted on the neck.

11. Capo tasto in accordance with claim 1, wherein a pivotable rocker with the string engaging region seated thereon is arranged on the first arm.

12. Capo tasto in accordance with claim 11, wherein a pivot axis of the rocker is parallel to a pivot axis of a pivot-slide bearing by means of which the first arm is mounted for pivotal movement and displacement on the second arm.

13. Capo tasto in accordance with claim 1, wherein the string engaging region is formed by an elastic material.

14. Capo tasto in accordance with claim 13, wherein the string engaging region is formed by an elastic pad.

15. Capo tasto in accordance with claim 14, wherein the elastic pad has an engaging surface which varies transversely to a direction of extent of the strings, the engaging surface thus being smaller for strings of larger diameter than for strings of smaller diameter.

16. Capo tasto in accordance with claim 15, wherein the elastic pad has a triangular free space.

17. Capo tasto in accordance with claim 1, wherein the engaging region for the neck rear side is formed by an elastic pad.

18. Capo tasto in accordance with claim 1, wherein the first arm has a channel-shaped region with upwardly extending side rims at which the string engaging region is arranged.

19. Capo tasto in accordance with claim 18, wherein a rocker is pivotally fixed on the upwardly extending side rims.

20. Capo tasto in accordance with claim 1, wherein the string engaging region extends beyond a front end of the first arm.

21. Capo tasto in accordance with claim 1, wherein a spring mechanism is arranged between the first arm and the second arm to exert a force for pushing and/or pivoting the first arm away from the second arm.

22. Capo tasto in accordance with claim 21, wherein the spring mechanism is supported on the first arm and the second arm.

23. Capo tasto in accordance with claim 21, wherein the spring mechanism has a spring region which is displaceable relative to the second arm and is supported thereon.

24. Capo tasto in accordance with claim 21, wherein a winding or several windings of the spring mechanism is or are arranged around a shaft of a pivot-slide bearing.

25. Capo tasto in accordance with claim 1, wherein the at least one first contacting surface is formed by an outer contour region of the first arm, which faces the second arm.

26. Capo tasto in accordance with claim 1, wherein the at least one second contacting surface is formed by an outer contour region of the second arm, which faces the first arm.

27. Capo tasto in accordance with claim 1, wherein the at least one first contacting surface is integrally formed on the first arm.

28. Capo tasto in accordance with claim 1, wherein the at least one second contacting surface is integrally formed on the second arm.

29. Capo tasto in accordance with claim 1, wherein the one arm is constructed at a coupling region with the other arm in the shape of a fork, with opposed fork elements engaging over the other arm.

30. Capo tasto in accordance with claim 29, wherein at least one contacting surface for the other arm is formed in an intermediate region between the fork elements.

31. Capo tasto in accordance with claim 21, wherein the at least one spring mechanism is so arranged and constructed that a fixing position on the neck is releasable by exerting pressure on the first arm in the direction of the neck rear side engaging region.

* * * * *